US006214503B1

(12) United States Patent
Gaidelis et al.

(10) Patent No.: US 6,214,503 B1
(45) Date of Patent: Apr. 10, 2001

(54) ORGANOPHOTORECEPTORS FOR ELECTROPHOTOGRAPHY FEATURING NOVEL CHARGE TRANSPORT COMPOUNDS BASED UPON HYDROXY-FUNCTIONAL COMPOUNDS

(75) Inventors: Valentas Gaidelis; Janina Gavutiene, both of Vilnius; Vytautas Getautis; Juozas Vidas Grazulevicius, both of Kaunas; Vygintas Jankauskas, Vilnius; Rimtautas Kavaliunas, Kaunas; Ruta Lazauskaite, Kaunas; Osvaldas Paliulis, Kaunas, all of (LT); Mitchell A. Rossman, Mendota Heights, MN (US); Donatas Jonas Sidaravicius, Vilnius (LT); Terrance P. Smith, Woodbury, MN (US); Albina Stanishauskaite, Kaunas (LT)

(73) Assignee: Imation Corp., Oakdale, MN (US)

( * ) Notice: Subject to any disclaimer, the term of this patent is extended or adjusted under 35 U.S.C. 154(b) by 0 days.

(21) Appl. No.: 09/469,967

(22) Filed: Dec. 21, 1999

(51) Int. Cl.[7] ..... G03G 5/047; G03G 5/09; G03G 15/00

(52) U.S. Cl. ..... 430/58.45; 430/58.6; 430/58.65; 430/83; 399/159

(58) Field of Search ..... 430/58.45, 58.6, 430/58.65, 83; 399/159

(56) References Cited

U.S. PATENT DOCUMENTS

| | | | |
|---|---|---|---|
| 4,420,548 | 12/1983 | Sakai et al. | 430/59 |
| 4,439,509 | 3/1984 | Schank | 430/132 |
| 4,565,760 | 1/1986 | Schank | 430/66 |
| 4,595,602 | 6/1986 | Schank | 430/67 |
| 4,606,934 | 8/1986 | Lee et al. | 430/67 |
| 4,923,775 | 5/1990 | Schank | 430/66 |
| 5,124,220 | 6/1992 | Brown et al. | 430/67 |
| 5,650,253 | 7/1997 | Baker et al. | 430/119 |
| 5,659,851 | 8/1997 | Moe et al. | 399/165 |

FOREIGN PATENT DOCUMENTS

| | | |
|---|---|---|
| 0504794 | 9/1992 | (EP) . |
| WO 95/02853 | 1/1995 | (WO) . |

OTHER PUBLICATIONS

Kalade et al., "Investigation of charge carrier transfer in electrophotographic layers of chalkogenide glasses," Proceed. ICPS 1994: The Physics and Chemistry of Imaging Systems, Rochester, NY, pp. 747–752.

*Primary Examiner*—Roland Martin
(74) *Attorney, Agent, or Firm*—Amelia A. Buharin

(57) ABSTRACT

The invention features organic photoreceptors that include a charge transport compound having the formula:

(1)

where X is an N-alkyl-substituted carbazole, an N-aryl-substituted carbazole, or a p-(N,N-disubstituted) arylamine;

Ar is a group having the formula:

$R^1$ is a hydrogen, halogen, or alkyl group; R is a hydrogen, halogen, OH, CN, $OR^2$, or $OCOR^3$ group; $R^2$ is an alkyl, aryl, or alkaryl group; $R^3$ is a hydrogen, alkyl, aryl, or haloalkyl group; n is 0 or 1; A is a group having the formula:

Z is O or S; Q is O, S, or $CH_2$; and m is 0 or 1.

32 Claims, No Drawings

ORGANOPHOTORECEPTORS FOR ELECTROPHOTOGRAPHY FEATURING NOVEL CHARGE TRANSPORT COMPOUNDS BASED UPON HYDROXY-FUNCTIONAL COMPOUNDS

BACKGROUND OF THE INVENTION

This invention relates to organic photoreceptors suitable for use in electrophotography.

In electrophotography, a photoreceptor in the form of a plate, belt, or drum having an electrically insulating photoconductive element on an electrically conductive substrate is imaged by first uniformly electrostatically charging the surface of the photoconductive layer, and then exposing the charged surface to a pattern of light. The light exposure selectively dissipates the charge in the illuminated areas, thereby forming a pattern of charged and discharged areas. A liquid or solid toner is then deposited in either the charged or discharged areas to create a toned image on the surface of the photoconductive layer. The resulting visible toner image can be transferred to a suitable receiving surface such as paper. The imaging process can be repeated many times.

Both single layer and multilayer photoconductive elements have been used. In the single layer embodiment, a charge transport material and a charge generating material are combined with a polymeric binder and then deposited on the electrically conductive substrate. In the multilayer embodiment, the charge transport material and charge generating material are in the form of separate layers, each of which can optionally be combined with a polymeric binder, deposited on the electrically conductive substrate. Two arrangements are possible. In one arrangement (the "dual layer" arrangement), the charge generating layer is deposited on the electrically conductive substrate and the charge transport layer is deposited on top of the charge generating layer. In an alternate arrangement (the "inverted dual layer" arrangement), the order of the charge transport layer and charge generating layer is reversed.

In both the single and multilayer photoconductive elements, the purpose of the charge generating material is to generate charge carriers (i.e., holes and electrons) upon exposure to light. The purpose of the charge transport material is to accept these charge carriers and transport them through the charge transport layer in order to discharge a surface charge on the photoconductive element.

To produce high quality images, particularly after multiple cycles, it is desirable for the charge transport material to form a homogeneous solution with the polymeric binder and remain in solution. In addition, it is desirable to maximize the amount of charge which the charge transport material can accept (indicated by a parameter known as the acceptance voltage or "$V_{acc}$"), and to minimize retention of that charge upon discharge (indicated by a parameter known as the residual voltage or "$V_{res}$").

Liquid toners generally produce superior images compared to dry toners. However, liquid toners also can facilitate stress crazing in the photoconductive element. Stress crazing, in turn, leads to printing defects such as increased background. It also degrades the photoreceptor, thereby shortening its useful lifetime. The problem is particularly acute when the photoreceptor is in the form of a flexible belt included in a compact imaging machine that employs small diameter support rollers (e.g., having diameters no greater than about 40 mm) confined within a small space. Such an arrangement places significant mechanical stress on the photoreceptor, and can lead to degradation and low quality images.

SUMMARY OF THE INVENTION

In a first aspect, the invention features an organic photoreceptor that may be provided, e.g., in the form of a drum or flexible belt. The photoreceptor includes:

(a) a first charge transport compound having the formula:

(1)

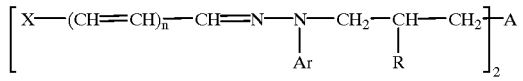

where X is an N-alkyl-substituted carbazole (e.g., where the alkyl group is a $C_1$–$C_6$ alkyl group), an N-aryl-substituted carbazole (e.g., where the aryl group is a phenyl or naphthyl group), or a p-(N,N-disubstituted) arylamine (e.g., a dialkyl-substituted phenyl or naphthyl amine); Ar is a group having the formula:

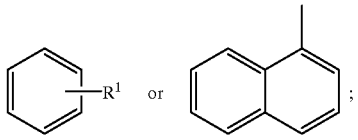

$R^1$ is a hydrogen, halogen, or alkyl group (e.g., a $C_1$–$C_6$ alkyl group);

R is a hydrogen, halogen, OH, CN, $OR^2$, or $OCOR^3$ group;

$R^2$ is an alkyl (e.g., a $C_1$–$C_6$ alkyl), aryl (e.g., phenyl or naphthyl), or alkaryl (e.g., tolyl) group;

$R^3$ is a hydrogen, alkyl (e.g., a $C_1$–$C_6$ alkyl), aryl (e.g., phenyl or naphthyl), or haloalkyl (e.g., chlorophenyl or chloronaphthyl) group; n is 0 or 1;

A is a group having the formula:

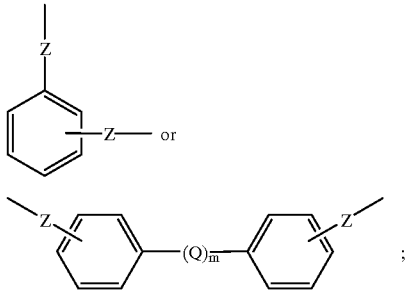

Z is O or S;

Q is O, S, or $CH_2$; and m is 0 or 1;

(b) a charge generating compound; and (c) an electroconductive substrate.

The charge transport compound may or may not be symmetrical. Thus, for example, groups X, Ar, and R for one "arm" of the compound may be the same or different from the X Ar, and R groups in the other "arm" of the compound.

The charge transport compound can function as both a charge transport compound and a binder, thereby facilitating the preparation of layered structures. For example, in one embodiment, the organic photoreceptor includes a layer deposited on the electroconductive substrate, in which the layer includes the charge transport compound and the charge generating compound.

In a second embodiment, the organic photoreceptor includes (a) a charge transport layer that includes the charge transport compound (and, optionally, a second charge transport compound having a different structure); (b) a charge generating layer that includes the charge generating compound (and, optionally, the charge transport compound); and (c) the electroconductive substrate. In one arrangement, the charge transport layer is intermediate the charge generating layer and the electroconductive substrate, while in another arrangement the charge generating layer is intermediate the charge transport layer and the electroconductive substrate. The charge transport layer, the charge generating layer, or both, may further include a separate polymeric binder such a polyvinyl butyral or polycarbonate.

Specific examples of suitable materials for the first charge transport compound include compounds having the following formulae:

(2)

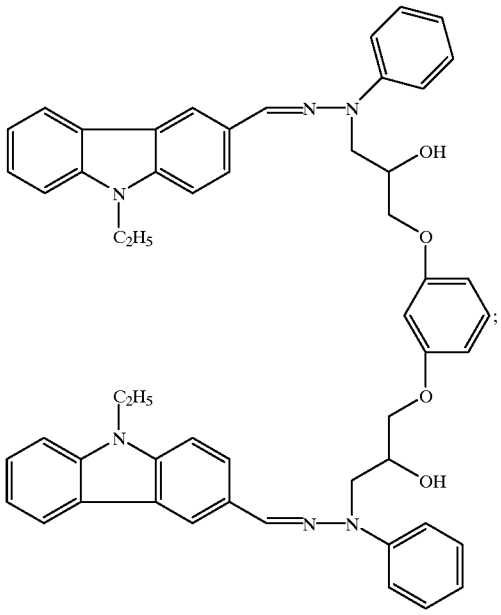

-continued (3)

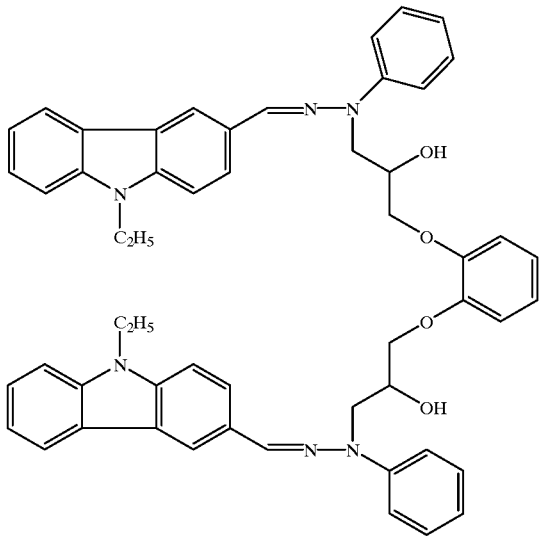

(4)

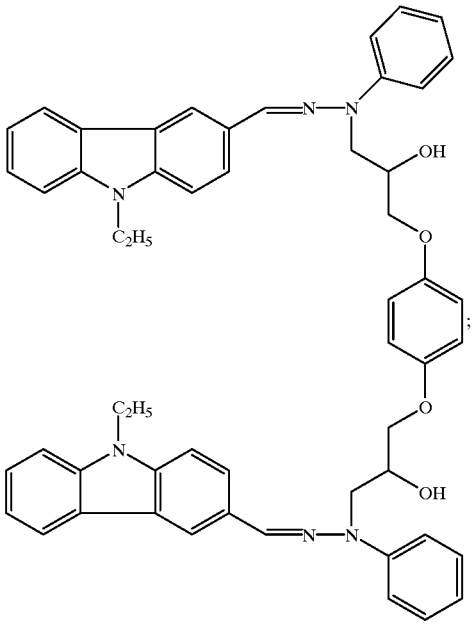

-continued
(5)
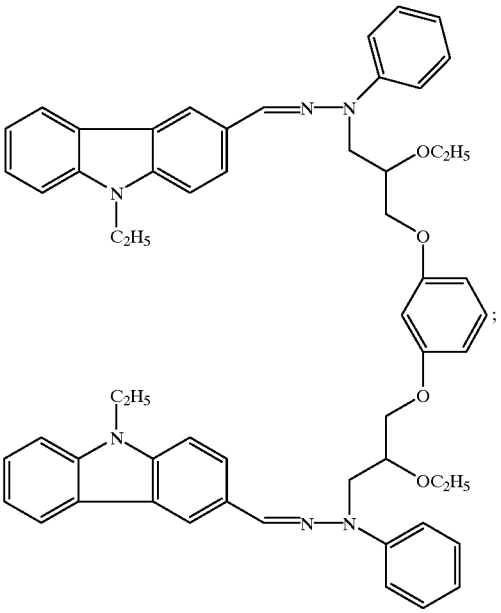
(6)
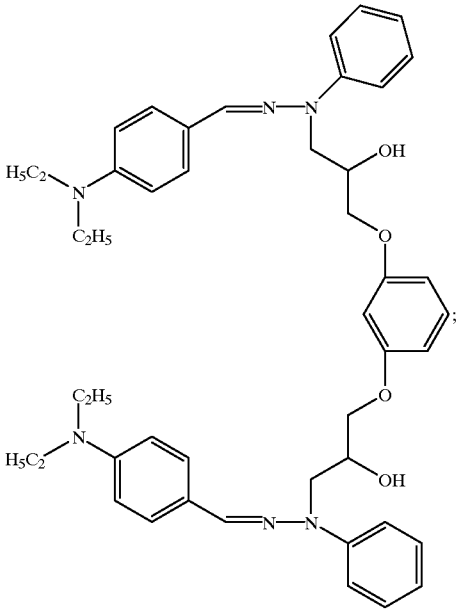
-continued
(7)
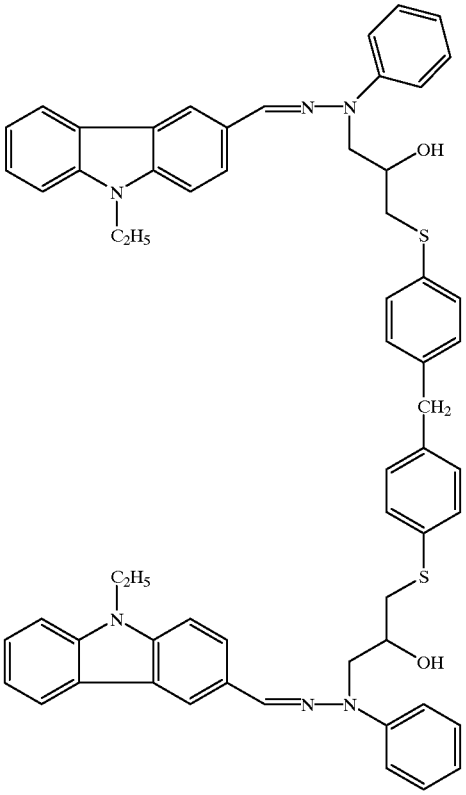
(8)
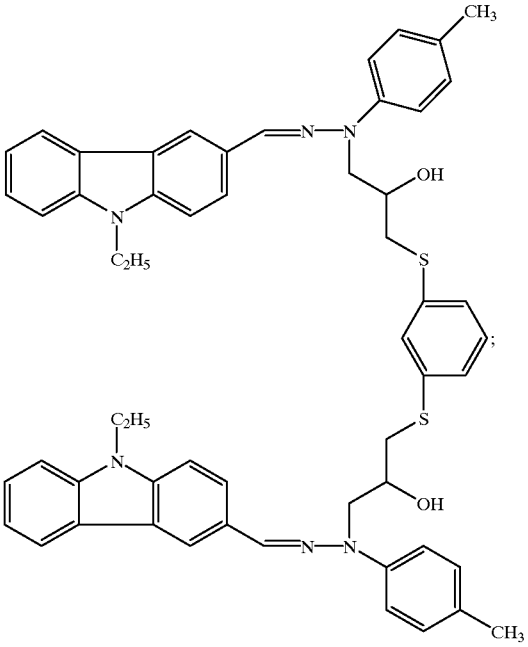

-continued (9)

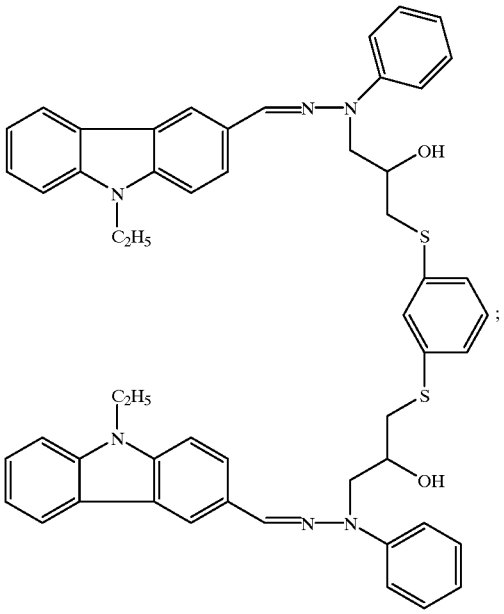

;

(10)

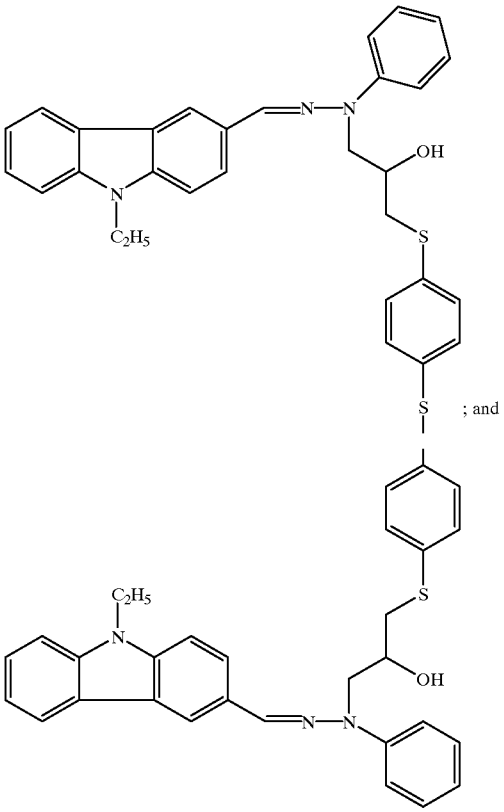

; and

-continued (11)

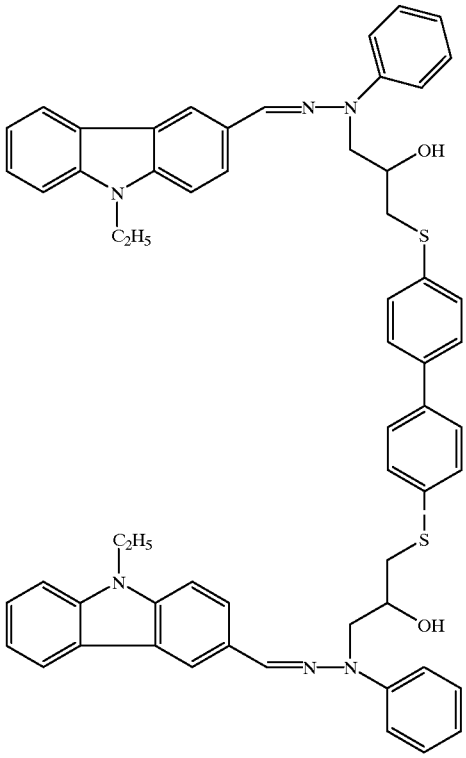

The invention also features the charge transport compounds themselves, as well as charge transport compounds, and organic photoreceptors based upon such charge transport compounds, that are the reaction product of a multifunctional isocyanate (i.e., an isocyanate reactant having two or more isocyanate groups available for reaction) and the above-described compounds in which R is a hydroxyl group. The isocyanate groups react with the hydroxy groups to form charge transport compounds having urethane linkages.

In a second aspect, the invention features an electrophotographic imaging apparatus that includes (a) a plurality of support rollers, at least one of which has a diameter no greater than about 40 mm; and (b) the above-described organic photoreceptor supported by these rollers. The apparatus preferably includes a liquid toner dispenser as well.

In a third aspect, the invention features an electrophotographic imaging process that includes (a) applying an electrical charge to a surface of the above-described organic photoreceptor; (b) imagewise exposing the surface of the organic photoreceptor to radiation to dissipate charge in selected areas and thereby form a pattern of charged and discharged areas on the surface; (c) contacting the surface with a liquid toner comprising a dispersion of colorant particles in an organic liquid to create a toned image; and (d) transferring the toned image to a substrate.

In a preferred embodiment, the organic photoreceptor is in the form of a flexible belt, e.g., a flexible belt supported by a plurality of support rollers, at least one of which has a diameter no greater than about 40 mm.

The invention provides organic photoreceptors featuring a combination of good mechanical properties and electrostatic properties. These photoreceptors can be used successfully with liquid toners to produce high quality images even when subjected to significant mechanical stresses encountered when the photoreceptor is in the form of a flexible belt supported by a plurality of small diameter rollers. The high quality of the images is maintained after repeated cycling.

Other features and advantages of the invention will be apparent from the following description of the preferred embodiments thereof, and from the claims.

DETAILED DESCRIPTION

The invention features organic photoreceptors that include charge transport compounds having the formulae set forth in the Summary of the Invention, above. The organic photoreceptor may be in the form of a plate, drum, or belt, with the novel charge transport compounds being particularly useful in the case of flexible belts. The photoreceptor may include a conductive substrate and a photoconductive element in the form of a single layer that includes both the charge transport compound, the charge generating compound, and, optionally, a separate polymeric binder. Preferably, however, the photoreceptor includes a conductive substrate and a photoconductive element that is a bilayer construction featuring a charge generating layer and a separate charge transport layer. The charge generating layer may be located intermediate the conductive substrate and the charge transport layer. Alternatively, the photoconductive element may be an inverted construction in which the charge transport layer is intermediate the conductive substrate and the charge generating layer.

The photoreceptors are suitable for use in an imaging process with either dry or liquid toner development. Liquid toner development is generally preferred because it offers the advantages of providing higher resolution images and requiring lower energy for image fixing compared to dry toners. Examples of useful liquid toners are well-known. They typically include a colorant, a resin binder, a charge director, and a carrier liquid. A preferred resin to pigment ratio is 2:1 to 10:1, more preferably 4:1 to 8:1. Typically, the colorant, resin, and the charge director form the toner particles.

The photoreceptors are particularly useful in compact imaging apparatus where the photoreceptor is wound around several small diameter rollers (e.g., having diameters no greater than about 40 mm). A number of apparatus designs may be employed, including, for example, the apparatus designs disclosed in U.S. Pat. No. 5,650,253 and U.S. Pat. No. 5,659,851, both of which are incorporated by reference.

The charge generating compound is a material which is capable of absorbing light to generate charge carriers, such as a dyestuff or a pigment. One example of a suitable charge generating compound is a metal-free phthalocyanine pigment (e.g., Progen 1 x-form metal-free phthalocyanine pigment from Zeneca, Inc.). Also suitable are Y-form oxytitanyl phthalocyanine pigments. Such pigments may be prepared according to the procedure described in the Examples, below.

The charge transport compound may act as a binder. It is also possible to combine the charge transport compound and/or the charge generating compound with a separate polymeric binder. Examples of the latter include styrene-butadiene copolymers, modified acrylic polymers, vinyl acetate polymers, styrene-alkyd resins, soya-alkyl resins, polyvinyl chloride, polyvinylidene chloride, acrylonitrile, polycarbonate, polyacrylic and methacrylic esters, polystyrene, polyesters, and combinations thereof. Examples of suitable polycarbonate binders include aryl polycarbonates such as poly(4,4-dihydroxy-diphenyl-1,1-cyclohexane) ("Polycarbonate Z") and poly(Bisphenol A carbonate co-4,4'(3,3,5-trimethyl cyclohexylidene diphenol).

A particularly useful binder is polyvinyl butyral. This material has free hydroxyl groups available for reaction, e.g., with isocyanate groups which may be present in the charge transport layer, the charge generating layer, additional layers, or a combination thereof Other layers that may be included in the photoreceptor include, for example, barrier layers and release layers. Examples of suitable barrier layers include crosslinkable siloxanol-colloidal silica hybrids (as disclosed, e.g., in U.S. Pat. Nos. 4,439,509; 4,606,934; 4,595,602; and 4,923,775); a coating formed from a dispersion of hydroxylated silsesquioxane and colloidal silica in an alcohol medium (as disclosed, e.g., in U.S. Pat. No. 4,565,760); a polymer resulting from a mixture of polyvinyl alcohol with methyl vinyl ether/maleic anhydride copolymer; and polyvinyl butyral crosslinked with a copolymer of maleic anhydride and methylvinyl ether (GANTKEZ AN169 from ISP Chemical, Wayne, N.J.) containing about 30% silica. Examples of suitable release layers include fluorinated polymers, siloxane polymers, silanes, polyethylene, and polypropylene, with crosslinked silicone polymers being preferred.

In one preferred embodiment, the charge transport compound has hydroxyl groups that are reacted with a multi-functional isocyanate have two or more isocyanate groups available for reaction. Other hydroxy-functional materials such as polyvinyl butyral may participate in the reaction as well. The crosslinked reaction product improves the mechanical properties of the photoreceptor, including stability to bending and stretching and insensitivity to agents such as solvents and oils found in liquid electrophotographic developers. Examples of suitable multi-functional isocyanates for this purpose include 1,6-hexamethylene diisocyanate, 1,4-tetramethylene diisocyanate, toluene diisocyanate, and diphenyl methane diisocyanate. Such compounds are commercially available and include those available under the trade designations DESMODUR L-75N, DESMODUR CB-75N, and DESMODUR HL available from Bayer of Pittsburgh, Pa.

In general, a solution containing the multi-functional isocyanate is mixed with a solution containing the charge transport compound just before coating. The resulting mixture is then coated onto a substrate and dried at elevated temperatures typically between 50° C. and 150° C. for a period ranging from 1–1000 minutes. To increase the speed of the crosslinking reaction, a catalyst such as dibutyl tin dilaurate may be included in an amount ranging from about 0.001 to 10 wt. % of total solids.

The invention will now be described further by way of the following examples.

EXAMPLES

A.1. Synthesis of Charge Transport Compounds

Charge transport compounds were synthesized as follows. The number associated with each compound refers to the number of the chemical formula set forth in the Summary of the Invention, above.

Compound (2)

37.0 g (0.1 mol) of 1-(2,3-epoxypropyl)-1-phenylhydrazone of 9-ethylcarbazol-3-aldehyde (N-ethyl-3-carbazolecarboxaldehyde-N-phenyl-N-2,3-epoxypropylhydrazone) and 4.4 g (0.04 mol) of 1,3-dihydroxybenzene were dissolved in 75 ml of chlorobenzene, after which 42.0 ml (0.3 mol) of triethylamine was added. The reaction mixture was heated for 25 h at 70–75° C. until the 1,3-dihydroxybenzene and its monosubstituted derivative disappeared. The course of the reaction was monitored by thin layer chromatography on Silufol UV-254 (KAVALIER) plates using a 7:3 v/v mixture of hexane and acetone as the eluent. After termination of the reaction, the solvent was evaporated in vacuo and the residue was crystallized from toluene. 25.0 g (67.7%) of the resultant product were filtered off and recrystallized from toluene to yield Compound (2) which had the following characteristics:

(a) Melting point=157.0–158.50° C.;

(b) IR spectrum (KBr)=3650–3200 $cm^{-1}$ (OH); 1250, 1200, 1185–1080 $cm^{-1}$ (C—O—C); 830–810, 785, 765, 745, 707 $cm^{-1}$ (CH═CH of carbazole, mono- and m-disubstituted benzene);

(c) PMR spectrum (90 MHz, $CDCl_3$)=1.22 ppm (6H, t, 2×$CH_3$); 2.95 ppm (2H, d 2×OH); 3.32–4.50 ppm (14H, m, 2×$CH_2CHCH_2$, 2×C$\underline{H}_2CH_3$); 6.38 ppm (4H, m, CH of disubstituted benzene); 6.60–8.08 ppm (26H, m, 2×CH═N, $CH_{Ht,\ Ar}$);

(d) Elemental analysis: Found, %: C 76.0; H 6.3; N 10.2. $C_{54}H_{52}N_6O_4$. Calculated, %: C 76.4; H 6.2; N 9.9.

Compound (3)

Compound (3) was prepared following the procedure used to prepare Compound (2) except that instead of 1,3-dihydroxybenzene, 1,2-dihydroxybenzene was used. After removal of the solvent, the residue was purified by chromatography using a column packed with aluminum oxide (neutral, Brockmann II, REANAL, Hungary) and a 4:1 v/v solution of hexane and acetone as the eluent to yield a solid amorphous material. A 20% solution of this material in toluene was prepared and then poured with intensive stirring into a 10-fold excess of hexane to yield 27.4 g (74.2%) of Compound (3) as a white powder with a yellow tint having the following characteristics:

(a) $T_g$=81° C.;

(b) IR spectrum (KBr)=3600–3200 $cm^{-1}$ (OH); 1285–1000 $cm^{-1}$ (C—O—C); 825, 810, 767, 710 $cm^{-1}$ (CH═CH of carbazole, mono- and o-disubstituted benzene);

(c) PMR spectrum (90 MHz, $CDCl_3$ with 2 drops of d-DMSO)=1.22 ppm (6H, t, 2×$CH_3$); 3.70–4.66 ppm (14H, m, 2×$CH_2CHCH_2$, 2×C$\underline{H}_2CH_3$); 4.96 ppm (2H, d, 2×OH); 6.50–8.15 ppm (30H, m, 2×CH═N, $CH_{Ht,\ Ar}$);

(d) Elemental analysis: Found, %: C 76.0; H 6.1; N 9.5. $C_{54}H_{52}N_6O_4$. Calculated, %: C 76.4; H 6.2; N 9.9.

Compound (4)

Compound (4) was prepared following the procedure used to prepare Compound (2) except that instead of 1,3-dihydroxybenzene, 1,4-dihydroxybenzene was used. The resulting mixture was refluxed in the same volume of toluene for 18 h. After completion of the reaction, the mixture was cooled. 25.9 g (70.1%) of crystalline product were filtered off and crystallized from dioxane to yield Compound (4) having the following characteristics:

(a) Melting point=210.5–212° C.;

(b) IR spectrum (KBr)=3600–3200 $cm^{-1}$ (OH); 1275–1070 $cm^{-1}$ (C—O—C); 835, 813, 757, 740, 705 $cm^{-1}$ (CH═CH of carbazole, mono- and p-disubstituted benzene);

(c) PMR spectrum (90 MHz, d-DMSO)=1.22 ppm (6H, t, 2×$CH_3$); 3.70–4.66 ppm (14H, m, 2×$CH_2CHCH_2$, 2×C$\underline{H}_2CH_3$); 5.4 ppm (2H, broad s, 2×OH); 6.66–8.30 ppm (30H, m, 2×CH═N, $CH_{Ht,\ Ar}$);

(d) Elemental analysis: Found, %: C 75.8; H 6.2; N 9.8. $C_{54}H_{52}N_6O_4$. Calculated, %: C 76.4; H 6.2; N 9.9.

Compound (5)

A mixture of Compound (2) (8.5 g, 1 mmol), dried potassium carbonate (2 g, 1.4 mmol), and powdered potassium hydroxide (2 g, 3 mmol) was stirred and heated at 50–55° C. for 2 h in 50 ml of iodoethane. The course of the reaction was monitored using thin layer chromatography according to the procedure used to synthesize Compound (2). After termination of the reaction, the mixture was filtered off and the organic solution was treated with 5% HCl (25 ml). The organic layer was separated and washed with water (3×25 ml), and then dried with magnesium sulfate. After removal of the iodoethane in vacuo, Compound (4) was isolated following the procedure described in the synthesis of Compound (3) except that instead of hexane, 2-propanol was used to yield 7.5 g (82.4%) of Compound (4) having the following characteristics:

(a) $T_g$=64° C.;

(b) IR spectrum (KBr)=1245, 1195, 1180–1080 $cm^{-1}$ (C—O—C); 780, 760, 743, 707 $cm^{-1}$ (CH═CH of carbazole, mono- and m-disubstituted benzene);

(c) PMR spectrum (90 MHz, $CDCl_3$)=1.02 ppm (6H, t, 2×O—$CH_2$C$\underline{H}_3$); 1.22 ppm (6H, t, 2×N—$CH_2$C$\underline{H}_3$); 3.12–3.66 ppm (4H, m, 2×O—C$\underline{H}_2CH_3$); 3.66–4.54 ppm (14H, m, 2×$CH_2CHCH_2$, 2×N—C$\underline{H}_2CH_3$); 6.22–8.20 ppm (30H, m, 2×CH═N, $CH_{Ht,\ Ar}$);

(d) Elemental analysis: Found, %: C 76.6; H 6.4; N 9.0. $C_{58}H_{60}N_6O_4$; Calculated, %: C 77.0; H 6.7; N 9.3.

Compound (6)

Compound (6) was prepared following the procedure used to prepare Compound (2) except that instead of 1-(2,3-epoxypropyl)-1-phenylhydrazone of 9-ethylcarbazol-3-aldehyde, 32.3 g (0.1 mol) of 1-(2,3-epoxypropyl)-1-phenylhydrazone of 4-diethylaminobenzaldehyde was used. The resulting product was isolated following the procedure used to prepare Compound (3) to yield 23.5 g (77.6%) of Compound (6) having the following characteristics:

(a) $T_g$=51° C.;

(b) IR spectrum (KBr)=3600–3200 $cm^{-1}$ (OH); 1275–1080 $cm^{-1}$ (C—O—C); 830, 765, 705 $cm^{-1}$ (CH═CH of carbazole, m- and p-disubstituted benzene);

(c) PMR spectrum (90 MHz, $CDCl_3$)=1.04 ppm (12H, t, 4×$CH_3$); 3.19 ppm (10H, m, 4×$CH_2CH_3$, 2×CH); 3.91 ppm (8H, m, 2×C$\underline{H}_2$CHC$\underline{H}_2$,); 4.20 ppm (2H, broad s, 2×OH); 6.22–7.68 ppm (24H, m, 2×CH═N, $CH_{Ht,Ar}$);

(d) Elemental analysis: Found, %: C 72.7; H 7.3; N 10.9. $C_{46}H_{56}N_6O_4$; Calculated, %: C 73.0; H 7.5; N 11.1.

Compound (7)

10.0 ml (0.07 mol) of triethylamine (as catalyst) were slowly added to a solution of 8.13 g (0.022 mol) of 9-ethyl-3-carbazolecarboxyaldehyde-N-2,3-epoxypropyl-N-phenylhydrazone and 2.3 g (0.01 mol) of di(4-mercaptophenyl)methane in 25 ml of chlorobenzene, while maintaining the temperature of the reaction mixture below 30° C. The reaction mixture was then stored overnight at room temperature. After evaporation of the solvent and triethylamine, the residue was dissolved in 25 ml of toluene and cooled to −5° C. 8.3 g (86.5%) of crystalline product were filtered off and recrystallized from toluene to yield Compound (7) having the following characteristics:

(a) Melting point=113–115° C.;

(b) IR spectrum (KBr)=3630–3280 $cm^{-1}$ (OH); 3050, 2971, 2926 $cm^{-1}$ (CH); 800, 712, 682 $cm^{-1}$ (CH═CH of carbazole, mono- and p-disubstituted benzene);

(c) PMR spectrum (250 MHz, $CDCl_3$ with 2 drops of d-DMSO)=1.32 ppm (6H, t, 2×$CH_3$); 3.06 ppm (4H, m, 2×S—$CH_2$); 3.65 ppm (2H, s, Ph-$CH_2$-Ph); 3.98 ppm (2H, m 2×C$\underline{H}$—OH); 4.05–4.34 ppm (8H, m, 2×CH—C$\underline{H}_2$—N, 2×C$\underline{H}_2$$CH_3$); 5.25 ppm (2H, d, 2OH); 6.80–7.58 ppm (26H, m, $CH_{Ht,\ Ar}$); 7.80 ppm (2H, d, 2×2-H of carbazole); 7.93 ppm (2H, s, 2×CH═N); 8.05 ppm (2H, d, 2×1-H of carbazole); 8.18 ppm (2H, s, 2×4-H of carbazole);

(d) Elemental analysis: Found, %: C 75.2; H 5.9; N 8.4. $C_{61}H_{58}N_6O_2S_2$; Calculated, %: C 75.4; H 6.0; N 8.6.

Compound (8)

Compound (8) was obtained from 8.43 g (0.022 mol) of 9-ethyl-3-carbazolecarboxyaldehyde-N-2,3-epoxypropyl-N-methylphenylhydrazone and 1.42 g (0.01 mol) of 1,3-benzenedithiol following the procedure used to prepare Compound (7). After removal of the solvent and the catalyst in vacuo, the product was isolated according to the procedure used to prepare Compound (7) except that instead of toluene, a mixture of toluene and 2-propanol (1:1 v/v) was used to yield 7.5 g (79.7%) of Compound (8) having the following characteristics:

(a) Melting point=133–135° C.;

(b) IR spectrum (film)=3630–3130 $cm^{-1}$ (OH); 3050, 2979, 2921 $cm^{-1}$ (CH); 809, 747, 730, 685 $cm^{-1}$ (CH═CH of carbazole and p- and m-disubstituted benzene);

(c) PMR spectrum (250 MHz, d-DMSO)=1.30 ppm (6H, t, 2×N—$CH_2$C$\underline{H}_3$); 2.23 ppm (6H, s, 2×Ph-$CH_3$); 3.25 ppm (4H, m, 2×S—$CH_2$); 3.95–4.28 ppm (6H, m, 2×C$\underline{H}$—OH, 2×CH—C$\underline{H}_2$—N); 4.40 ppm (4H, k, 2×C$\underline{H}_2$$CH_3$); 5.63 ppm (2H, d, 2×OH); 7.06–7.66 ppm (20H, m, $CH_{Ht,\ Ar}$); 7.88 ppm (2H, d, 2×2-H of carbazole); 8.00 ppm (2H, s, 2×CH═N); 8.20 ppm (2H, d, 2×1-H of carbazole); 8.29 ppm (2H, s, 2×4-H of carbazole);

(d) Elemental analysis: Found, %: C 73.6; H 6.0: N 9.1. $C_{56}H_{56}N_6O_2S_2$; Calculated, %: C 74.0; H 6.2; N 9.2.

Compound (9)

Compound (9) was prepared following the procedure used to prepare Compound (7) except that instead of di(4-mercaptophenyl)methane, 1.42 g (0.01 mol) of 1,3-benzenedithiol was used. After removal of the solvent and the catalyst, the residue was purified by chromatography using a column packed with aluminum oxide (neutral, Brockmann II, REANAL, Hungary) and a 4:1 v/v solution of hexane and acetone as the eluent. The resulting product was crystallized and recrystallized from toluene to yield 6.2 g (70.4%) of Compound (9) having the following characteristics:

(a) Melting point=107–109° C.;

(b) IR spectrum (KBr)=3620–3260 $cm^{-1}$ (OH); 3056, 2965, 2913 $cm^{-1}$ (CH); 801, 743, 691 $cm^{-1}$ (CH═CH of carbazole, mono- and m-disubstituted benzene);

(c) PMR spectrum (250 MHz, $CDCl_3$)=1.25 ppm (6H, t, 2×N—$CH_2$C$\underline{H}_3$); 3.00 ppm (4H, m, 2×S—$CH_2$); 3.25 ppm (2H, s, 2×OH); 3.52–4.20 ppm (10H, m, 2×CH—$CH_2$—N, 2×C$\underline{H}_2$$CH_3$); 6.85–8.15 ppm (30H, m, $CH_{Ht,\ Ar,}$ 2×CH═N);

(d) Elemental analysis: Found, %: C 73.3; H 5.8; N 9.3. $C_{54}H_{52}N_6O_2S_2$; Calculated, %: C 73.6; H 5.9; N 9.5.

Compound (10)

Compound (10) was obtained from 8.13 g (0.022 mol) of 9-ethyl-3-carbazolecarboxaldehyde-N-2,3-epoxypropyl-N-phenylhydrazone and 2.5 g (0.01 mol) of 4,4'-thiobisbenzenethiol following the procedure used to prepare Compound (7). After all the catalyst had been added, the reaction mixture was allowed to stand for 1 h at room temperature, after which the crystalline product was filtered off and recrystallized from chlorobenzene to yield 7.9 g (79.8%) of Compound (10) having the following characteristics:

(a) Melting point=183–184.5° C.;

(b) IR spectrum (film)=3620–3200 $cm^{-1}$ (OH); 3054, 2975, 2930 $cm^{-1}$ (CH); 810, 749, 694 $cm^{-1}$ (CH═CH of carbazole, mono- and p-disubstituted benzene);

(c) PMR spectrum (250 MHz, d-DMSO)=1.30 ppm (6H, t, 2×N—$CH_2$C$\underline{H}_3$); 3.18 ppm (4H, m, 2×S—$CH_2$); 4.00–4.50 ppm (10H, m, 2×CH—$CH_2$—N, 2×C$\underline{H}_2$$CH_3$); 5.60 ppm (2H, d, 2×OH); 6.80–7.60 ppm (26H, m, $CH_{Ht,\ Ar}$); 7.85 ppm (2H, d, 2×2-H of carbazole); 8.05 ppm (2H, s, 2×CH═N); 8.20 ppm (2H, d, 2×1-H of carbazole); 8.30 ppm (2H, s, 2×4-H of carbazole);

(d) Elemental analysis: Found, %: C 72.5; H 5.6; N 8.2. $C_{60}H_{56}N_6O_2S_3$; Calculated, %: C 72.8; H 5.7; N 8.5.

Compound (11)

Compound (11) was prepared following the procedure used to prepare Compound (10) except that instead of 4,4'-thiobisbenzenethiol, 2.18 g (0.01 mol) of 4,4'-dimercaptobiphenyl was used. 8.2 g (86.3 %) of crystalline product were filtered off and recrystallized from 1,2-dichlorobenzene to yield Compound (11) having the following characteristics:

(a) Melting point=240° C. (decomposed);

(b) IR spectrum (KBr)=3620–3260 $cm^{-1}$ (OH); 3050, 2965, 2886 $cm^{-1}$ (CH); 806, 735, 706 $cm^{-1}$ (CH═CH of carbazole, mono- and p-disubstituted benzene);

(c) PMR spectrum (250 MHz, d-DMSO)=1.28 ppm (6H, t, 2×$CH_3$); 3.22 ppm (4H, m, 2×S—$CH_2$); 4.18 ppm (6H, m, 2×CH—$CH_2$—N); 4.38 ppm (4H, k, 2×C$\underline{H}_2$$CH_3$); 5.59 ppm (2H, d, 2×OH); 6.78–7.66 ppm (26H, m, $CH_{Ht,\ Ar}$); 7.85 ppm (2H, d, 2×2-H of carbazole); 8.00 ppm (2H, s, 2×CH═N); 8.14 ppm (2H, d, 2×1-H of carbazole); 8.28 ppm (2H, s, 2×4-H of carbazole);

(d) Elemental analysis: Found, %: C 75.0; H 5.8; N 8.4. $C_{60}H_{56}N_6O_2S_2$; Calculated, %: C 75.3; H 5.9; N 8.8.

A.2. Synthesis of Y-Form Oxytitanyl Phthalocyanines 25.6 g (0.2 mol) of o-dicyanobenzene was dissolved in 200 ml of distilled quinoline at room temperature in a 500 ml flask equipped with a stirrer, an air cooler with a $CaCl_2$ drying tube, and an addition funnel having a branch for pressure leveling and a nitrogen inlet. 5.5 ml (9.5 g, 0.05 mol) of titanium tetrachloride was then added dropwise with stirring to form a red solution. Next, the temperature was raised to 210° C. and the solution was stirred for 6 hours at this temperature. At the end of this period, the solution had turned dark green. The solution was then cooled to 130° C. and filtered through a Buchner funnel. The precipitate was washed several times with 100 ml portions of hot (130° C.) quinoline, followed successively by acetone, a 3% aqueous ammonia solution, water, a 3% aqueous HCl solution, water, and acetone, to yield 23 g of blue-violet crystals of crude titanyl-o-phthalocyanine (TiOPc).

3 g of the crude TiOPc in an ice bath were dissolved in 60 ml of concentrated sulfuric acid. 20 ml of diluted sulfuric acid (1:1 dilution) were then added, after which the resulting mixture was added dropwise to 51 of intensely stirred distilled water over the course of 1 hour. The resulting precipitate was filtered off and washed with distilled water until neutral pH was reached, after which it was washed with a 3% aqueous ammonia solution followed by water to yield a wet paste. Next, the wet paste was mixed thoroughly with 60 ml of 1,2-dichloroethane for 5 hours. At the end of the reaction period, water was removed by centrifuging and the resulting suspension was dried in air to yield Y-form titanyl phthalocyanine pigment. X-ray diffraction measurements revealed three major peaks at Bragg angles of 9.6°, 24.1°, and 27.2°, which are characteristic of Y-form oxytitanyl phthalocyanines.

B. Electrostatic Testing

Example 1

A photoreceptor incorporating a charge transport layer formed from Compound (2) and a binder was prepared as follows.

A charge transport solution was prepared by combining 1 g of Compound (2), 1 g of Polycarbonate PK Z-200 binder (commercially available from Mitsubishi Gas Chemical), and 25 ml of tetrahydrofuran. The solution was then coated onto an indium-tin oxide glass substrate having a 1 micrometer thick casein barrier layer and dried at 70° C. for 15 hours to form a charge transport layer. The thickness of the charge transport layer was 11 micrometers.

A dispersion was prepared by combining 150 mg of Y-form oxytitanyl phthalocyanine (prepared as described above), 75 mg of polyvinyl butyral (commercially available from Aldrich Chemical), and 4 ml of tetrahydrofuran. The resulting dispersion was shaken for 4 hours in a vibration mill, after which it was diluted with tetrahydrofuran (1:14 dilution by volume) and spray-coated onto the charge transport layer to form a charge generating layer having an optical density of 0.50 at 780 nm.

Electrostatic testing was performed and recorded using a scorotron and a C8-13 memory oscilloscope at ambient temperature. Charge-up was performed at 8 KV. The grid potential was +1500 V and the charging time was 3.5 seconds. The initial potential, $U_0$, was measured after charging. Discharge was performed by exposing the photoreceptor to 780 nm monochromatic light from an MDR-23 grating monochromator. Light intensity (L) at the sample surface was $1.35\times10^{-2}$ W/m$^2$. Potential half decay time $t_{1/2}$ at illumination was measured and the photosensitivity (S) was calculated according to the formula:

$$S=(1/t_{1/2})(1/L)$$

where L is the intensity of the incident light. Residual potential, $U_R$, was measured at 10 times the half decay time (i.e., $10\times t_{1/2}$). The results are shown in Table 1.

In a separate experiment, the sample was charged up to an initial potential corresponding to an initial field strength across the photoreceptor of $4\times10^5$ V/cm and illuminated with a 2 microsecond light pulse. The post-illumination potential decay curve was recorded and hole mobility ($\mu10^6$) calculated according to the method described in Kalade et al., "Investigation of Charge Carrier Transfer in Electrophotographic Layers of Chalcogenide Glasses," Proceed. ICPS '94: The Physics and Chemistry of Imaging Systems, New York, 1992, pp. 747–52. The results are shown in Table 1.

Example 2

The procedure of Example 1 was followed except that the charge transport compound was Compound (3). The test results are reported in Table 1.

Example 3

The procedure of Example 1 was followed except that the charge transport compound was Compound (5). The test results are reported in Table 1.

Example 4

The procedure of Example 1 was followed except that the binder used to prepare the charge transport layer was polyvinyl butyral (Aldrich Chemical Co.), rather than Polycarbonate Z-200. The test results are reported in Table 1.

Example 5

The procedure of Example 1 was followed except that the charge transport layer was prepared by combining 0.5 g of Compound (2), 1 g polyvinyl butyral, 25 mL tetrahydrofuran, and 0.5 g of a charge transport compound having the formula:

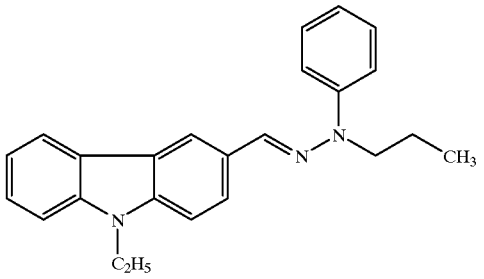

The test results are reported in Table 1.

Example 6

The procedure of Example 5 was followed except that the amount of polyvinyl butyral was 0.5 g. The test results are reported in Table 1.

Example 7

The procedure of Example 1 was followed except that 75 mg of Compound (2) was added to the composition used to prepare the charge generating coating. The test results are reported in Table 1.

TABLE 1

| EXAMPLE | $U_O$ (V) | S (m$^2$/J) | $U_R$ (V) | $\mu.10^6$ (cm$^2$/V.s) |
|---|---|---|---|---|
| 1 | +800 | 98 | 150 | 0.12 |
| 2 | +1200 | 105 | 220 | 0.12 |
| 3 | +1000 | 114 | 220 | 0.25 |
| 4 | +800 | 123 | 120 | 0.050 |
| 5 | +850 | 184 | 120 | 0.10 |
| 6 | +600 | 184 | 80 | 0.25 |
| 7 | +1050 | 211 | 130 | — |

Example 8

A photoreceptor incorporating a charge transport layer formed from Compound (7) and a binder was prepared as follows.

A charge transport solution was prepared by combining 1 g of Compound (7), 75 mg of polyvinyl butyral binder, and 4 ml of tetrahydrofuran. The solution was then coated onto a strip of aluminum-coated polyester by dip coating and dried at 80° C. for 15 minutes to form a charge transport layer. The thickness of the charge transport layer was 10 micrometers.

A dispersion was prepared by combining 150 mg of Y-form titanyl phthalocyanine (prepared as described above), 75 mg of polyvinyl butyral, and 4 ml of tetrahydrofuran. The resulting dispersion was shaken for 4 hours in a vibration mill, after which it was diluted with tetrahydrofuran (1:14 dilution by volume), spray-coated onto the charge transport layer, and dried for 15 hours at 80° C. to form a charge generating layer having an optical density of 0.50 at 780 nm.

Electrostatic testing was performed as described in Example 1. The results are shown in Table 2.

Example 9

The procedure of Example 8 was followed except that the composition used to prepare the charge transport layer contained 1 g of Compound (7), 1 g polyvinyl butyral, and 4 mL tetrahydrofuran. The test results are reported in Table 2.

Example 10

The procedure of Example 8 was followed except that the charge transport compound was Compound (8). The test results are reported in Table 2.

Example 11

The procedure of Example 9 was followed except that the charge transport compound was Compound (8). The test results are reported in Table 2.

Example 12

The procedure of Example 8 was followed except that the charge transport compound was Compound (9). The test results are reported in Table 2.

Example 13

The procedure of Example 9 was followed except that the charge transport compound was Compound (9). The test results are reported in Table 2.

Example 14

The procedure of example 8 was followed except that the charge transport compound was Compound (10). The test results are reported in Table 2.

Example 15

The procedure of Example 9 was followed except that the charge transport compound was Compound (10). The test results are reported in Table 2.

TABLE 2

| EXAMPLE | $U_O$ (V) | S ($m^2$/J) | $U_R$ (V) | $\mu.10^6$ ($cm^2$/V.s) |
|---|---|---|---|---|
| 8 | +1000 | 147 | 140 | 3.0 |
| 9 | +1000 | 184 | 120 | 0.10 |
| 10 | +920 | 114 | 110 | 3.8 |
| 11 | +1100 | 114 | 140 | 0.05 |
| 12 | +820 | 164 | 130 | 4.8 |
| 13 | +1400 | 176 | 150 | 0.10 |
| 14 | +1000 | 148 | 100 | 5.0 |
| 15 | +940 | 231 | 100 | 0.18 |

Example 16

A charge transport solution was prepared as follows. 186 mg of Compound (10) and 70 mg of polyvinyl butyral were dissolved in 3 ml of tetrahydrofuran in a vial. In a separate vial, 30 mg of DESMODUR L75 polyisocyanate (commercially available from Bayer Chemicals, Pittsburgh, Pa.) were dissolved in 1 ml of tetrahydrofuran. The two solutions were mixed together to form a charge transport solution which was then coated onto an aluminum-coated polyester film (thickness=80 micrometers). After evaporating the solvent at room temperature, the layer was heated at a temperature between 70° C. and 80° C. for 10 minutes to achieve crosslinking among the polyisocyanate, Compound (10), and the polyvinyl butyral. The thickness of the resulting charge transport layer was 8–9 micrometers.

A dispersion was prepared by combining 150 mg of Y-form titanyl phthalocyanine (prepared as described above), 75 mg of polyvinyl butyral, and 4 ml of tetrahydrofuran. One drop of surfactant [$C_8H_{17}$—$C_6H_4$—$(OCH_2CH_2)_7$—OH] was added and the resulting dispersion was shaken for 3 hours in a vibration mill. It was then diluted by adding 6 ml of tetrahydrofuran.

2 ml of the resulting dispersion was combined with 2 ml of a tetrahydrofuran solution prepared from 15 mg of DESMODUR L75, 4 ml of tetrahydrofuran, and 6 ml of methyl isobutyl ketone. The dispersion was then spray coated on top of the charge transport layer. The amount solids deposited was 0.02 mg/$cm^2$. Following spray coating, the sample was heated at 78–80° C. for 15 minutes.

Next, an overcoat solution was prepared by combining 25 mg of polyvinyl butyral, 25 mg of DESMODUR L75 dissolved in 1 ml of tetrahydrofuran, 4 ml of methyl isobutyl ketone, 4 ml of tetrahydrofuran, and 50 mg of an electron transporting material having the formula:

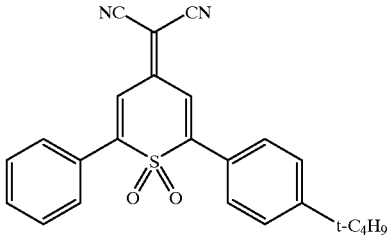

The overcoat solution was spray coated on top of the charge generating layer. The amount of solids deposited was 0.08 mg/$cm^2$. After spray coating, the solvent was evaporated at room temperature, followed by heating at a temperature between 70° C. and 80° C. to effect crosslinking.

Electrostatic testing was performed as described in Example 1. The results are shown in Table 3.

Example 17

A photoreceptor was prepared and tested as described in Example 16 except that the charge transport layer was prepared from 150 mg of Compound (2), 50 mg of polyvinyl butyral, 50 mg of DESMODUR L75, and 4 ml of tetrahydrofuran. In addition, the sample was heated for 5 hours following deposition of the charge generating layer and the overcoat solution was omitted. The results are shown in Table 3.

Example 18

A photoreceptor was prepared and tested as described in Example 16 except that the charge transport layer was prepared from 150 mg of Compound (2), 50 mg of polyvinyl butyral, 50 mg of DESMODUR L75, and 4 ml of tetrahydrofuran. In addition, the sample was heated for 10 minutes following deposition of the charge generating layer. The results are shown in Table 3.

The sample was also subject to additional electrostatic testing using a QEA PDT-2000 instrument at ambient temperature. Charge-up was performed at 8 kV. Discharge was performed by exposing the photoreceptor to a 780 nm filtered tungsten light source down a fiber optic cable. Each sample was exposed to 2 $\mu$j/cm$^2$ of energy for 0.05 seconds; the total exposure intensity was 20 $\mu$W/cm$^2$. After charge-up, the acceptance voltage ($V_{acc}$) was measured in volts. This value was recorded as $V_{acc}$ after one cycle. Following this initial charge-up, a one second dark decay followed before the sample was discharged with the 0.05 second light pulse of 2 $\mu$J/cm$^2$ at 780 nm, after which the residual voltage ($V_{res}$) was measured in volts. This value was recorded as $V_{res}$ after one cycle. $V_{acc}$ and $V_{res}$ were also measured after a total of 1000 cycles. In general, it is desirable to maximize $V_{acc}$ and to minimize $V_{res}$. After 1 cycle, the $V_{acc}$ and $V_{res}$ values were 680 and 200 volts, respectively. After 1000 cycles, these values were 700 and 270 volts, respectively.

Example 19

A photoreceptor was prepared and tested as described in Example 18 except that the charge transport layer was prepared from 186 mg of Compound (2), 70 mg of polyvinyl butyral, 30 mg of DESMODUR L75, and 4 ml of tetrahydrofuran. In addition, the sample was not heated following coating of both the charge transport layer and the charge generating layer. Following application of the overcoat solution, the sample was heated for 5 hours at 70–80° C. to effect crosslinking. The results are shown in Table 3.

TABLE 3

| EXAMPLE | $U_O$ (V) | S (m$^2$/J) | $U_R$ (V) |
|---|---|---|---|
| 16 | +850 | 164 | 110 |
| 17 | +800 | 184 | 80 |
| 18 | +800 | 194 | 100 |
| 19 | +800 | 190 | 100 |

Example 20

A charge transport layer was prepared by adding 18.1 of Compound (2) to 100 g of a 6% solution of S-Lec B BX-5 polyvinyl butyral resin (Sekisui Chemical Co.) in tetrahydrofuran. The resulting solution was mixed with 5.0 g DESMODUR N75 and die-coated onto a 3 mil (76 micrometer) thick aluminized polyethylene film (Melinex 442 polyester film from DuPont having a 1 ohm/square aluminum vapor coat), after which it was dried at 150° C. for 3 minutes to form a dry film having a thickness of 9 micrometers.

A dispersion of charge generating material was prepared by micronising Progen 1 pigment (commercially available from Zeneca, Inc.) and S-Lec BX-5 polyvinyl butyral resin in a 2:1 by volume solvent mixture of methyl ethyl ketone and toluene using a horizontal sand mill operating in recirculation mode for 8 hours. The pigment was dispersed into the resin at 9% solids. A 4% solids solution was then prepared from the dispersion and die-coated onto the charge transport layer, after which it was dried for 3 minutes at 150° C.

The electrostatic properties of the sample were determined as described in Example 18. After 1 cycle, the $V_{acc}$ and $V_{res}$ values were 440 and 50 volts, respectively. After 1000 cycles, these values were 566 and 90 volts, respectively.

Example 21

A photoreceptor prepared according to Example 16 was charged and its initial potential $U_0$ measured according to the procedure described in Example 1. Next, the sample was illuminated with a 2 microsecond light pulse from a flash lamp and the potential values were measured 50 ms ($U_{50}$) and 300 ms after illumination ($U_{300}$). The photoinduced discharge characteristic PIDC) was then calculated according to the formula:

$$PIDC=(U_0-U_{50})/(U_0-U_{300})$$

The value of the PIDC was calculated to be 0.91, indicating that the photoreceptor has excellent photospeed.

C. Solvent Resistance

Example 22

A solution of charge transport material prepared as described in Example 1 was coated onto a 3 cm wide by 20 cm long strip of polyester film provided with an aluminum layer and an adhesive layer. The adhesive layer was a 0.2 micrometer coating of PE 2200 polyester adhesive (commercially available from Shell Chemical Co.). After drying, a 10 micrometer thick charge transport layer was formed. The ends of the strip were joined with adhesive tape to form a belt with the charge transport layer facing outward. The belt was then wrapped around a 0.75 inch (19 mm) diameter spindle and a 2.4 kg load was attached to the strip. Next, a pad soaked with NORPAR 12 hydrocarbon solvent (commercially available from Exxon Corp.) was placed on the portion of the belt wrapped around the spindle. Soaking and tension were maintained for 10 minutes, after which the charge transport layer was removed from the spindle and examined under a microscope (100×magnification). No cracks were found.

Example 23

The procedure of Example 22 was followed except that the spindle was a 0.5 inch (12.7 mm) diameter spindle and the sample was the photoreceptor prepared according to the procedure of Example 16. Upon examination under a microscope, no cracks were found in the photoreceptor surface.

Example 24

The procedure of Example 23 was followed except that the sample was the photoreceptor prepared according to the procedure of Example 17. Upon examination under a microscope, no cracks were found in the photoreceptor surface.

Example 25

The procedure of Example 23 was followed except that the sample was the photoreceptor prepared according to the procedure of Example 18. Upon examination under a microscope, no cracks were found in the photoreceptor surface.

Example 26

The procedure of Example 23 was followed except that the photoreceptor sample measured 120 cm long by 21 cm wide and was prepared according to the procedure of Example 21. The belt formed from the photoreceptor was wrapped around a pair of spindles, each of which measured 0.5 inch (12.7 mm) in diameter. The lower spindle was loaded with static weights to achieve a total load of 17 kg. A pad soaked in NORPAR 12 was wrapped around the upper spindle and held in place with a clip. After 10 minutes, the NORPAR was wiped away and the photoreceptor surface was examined by optical microscopy at 100 times magnification. No cracks were observed.

The experiment was repeated using a pair of spindles each measuring 0.75 inch (18.8 mm) in diameter. Again, no cracks were observed.

Other embodiments are within the following claims.

What is claimed is:

1. An organic photoreceptor comprising:

(a) a first charge transport compound having the formula:

(1)

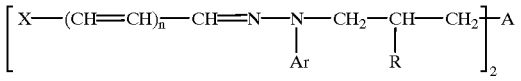

where X is an N-alkyl-substituted carbazole, an N-aryl-substituted carbazole, or a p-(N,N-disubstituted) arylamine;

Ar is a group having the formula:

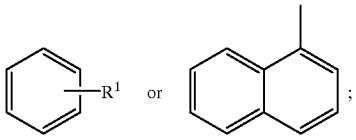

$R^1$ is a hydrogen, halogen, or alkyl group;

R is a hydrogen, halogen, OH, CN, $OR^2$, or $OCOR^3$ group;

$R^2$ is an allyl, aryl, or alkaryl group;

$R^3$ is a hydrogen, alkyl, aryl, or haloalkyl group;

n is 0 or 1;

A is a group having the formula:

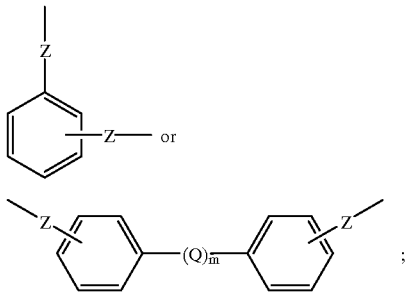

Z is O or S;

Q is O, S, or $CH_2$; and m is 0 or 1;

(b) a charge generating compound; and (c) an electroconductive substrate.

2. An organic photoreceptor according to claim 1 comprising a layer deposited on said electroconductive substrate, said layer comprising said first charge transport compound and said charge generating compound.

3. An organic photoreceptor according to claim 1 comprising:

(a) a charge transport layer comprising said first charge transport compound;

(b) a charge generating layer comprising said charge generating compound; and (c) said electroconductive substrate.

4. An organic photoreceptor according to claim 1 further comprising a second charge transport compound.

5. An organic photoreceptor according to claim 3 wherein said charge generating layer further comprises said first charge transport compound.

6. An organic photoreceptor according to claim 3 wherein said charge transport layer further comprises a polymeric binder.

7. An organic photoreceptor according to claim 6 wherein said polymeric binder comprises polyvinyl butyral.

8. An organic photoreceptor according to claim 3 wherein said charge generating layer further comprises a polymeric binder.

9. An organic photoreceptor according to claim 8 wherein said polymeric binder comprises polyvinyl butyral.

10. An organic photoreceptor according to claim 1 wherein said first charge transport compound is selected from the group consisting of (2)
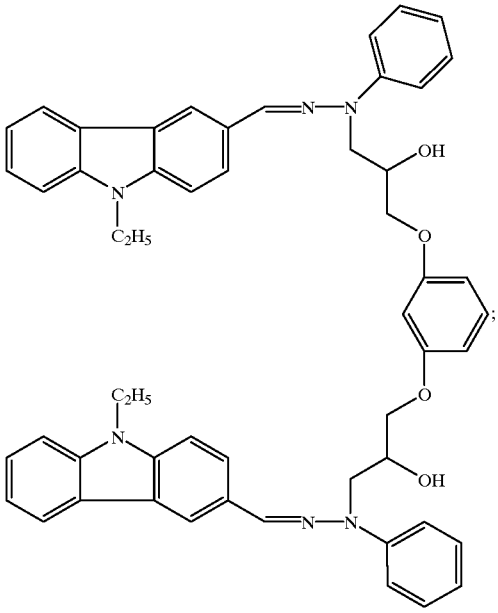
(3)
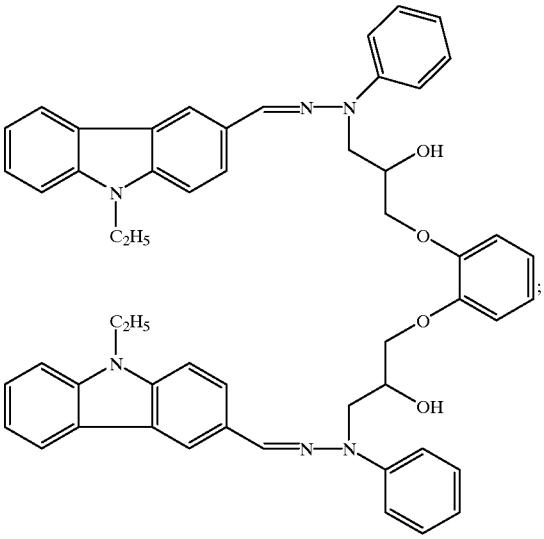
-continued
(4)
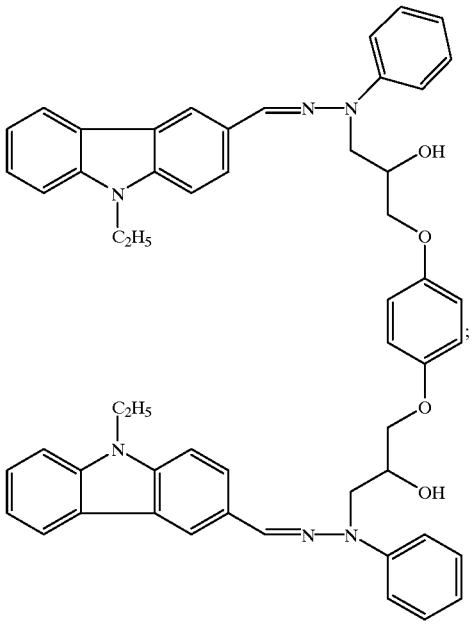
(5)
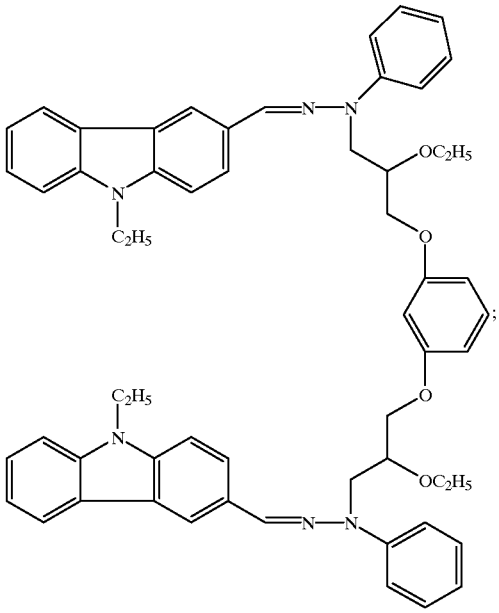

-continued
(6)
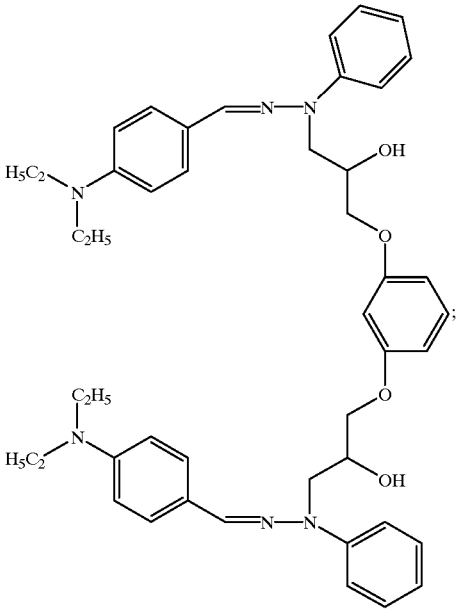
(7)
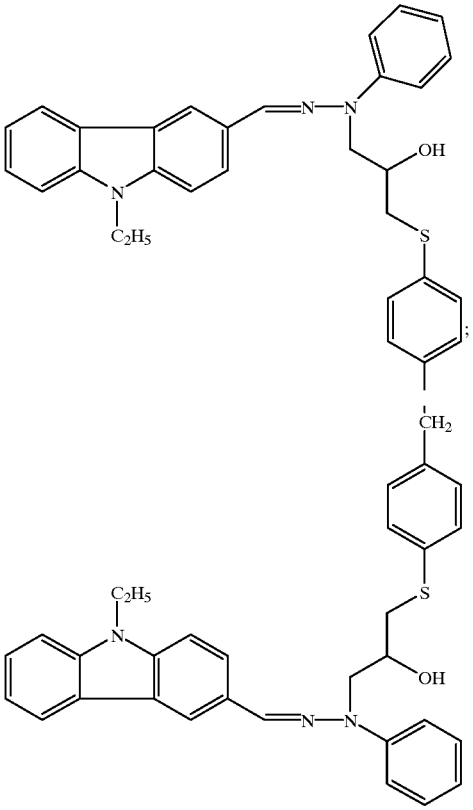
-continued
(8)
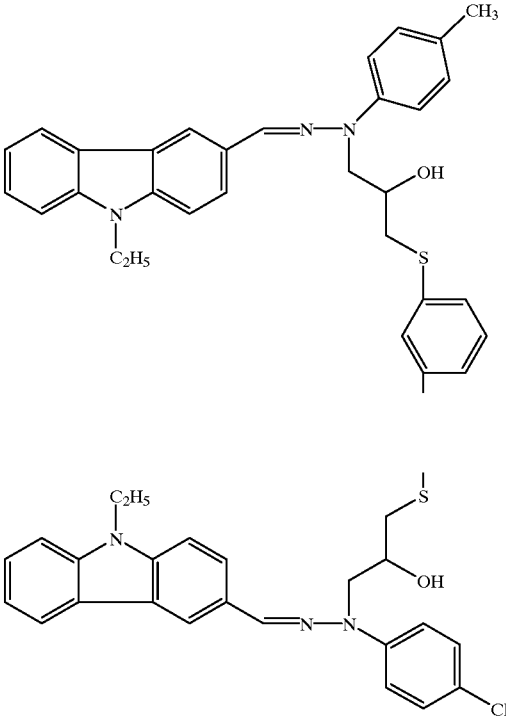
(9)
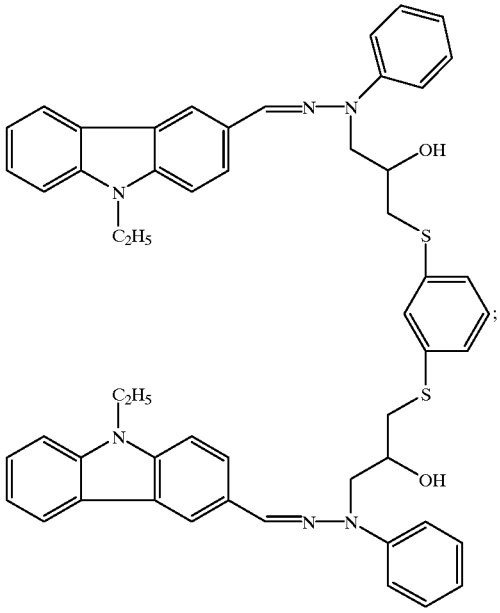

-continued (10)

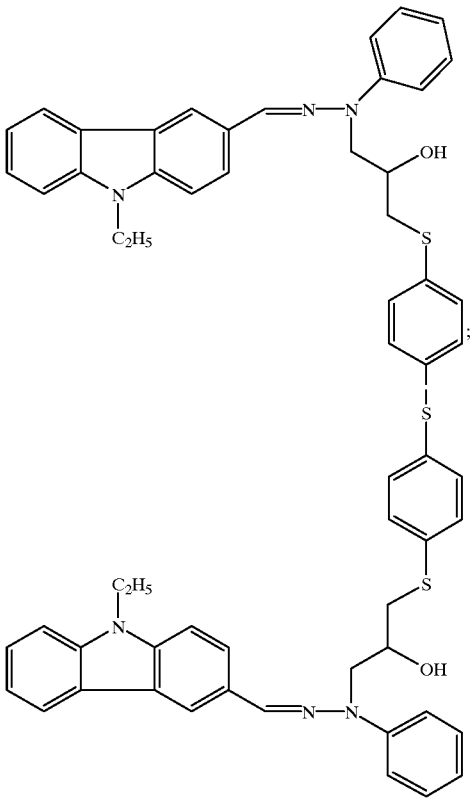

(11)

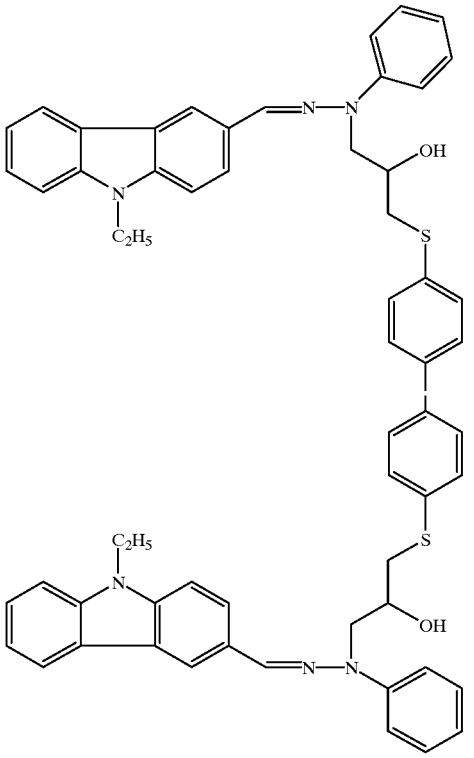

and combinations thereof.

11. An organic photoreceptor according to claim 1 wherein said photoreceptor is in the form of a flexible belt.

12. An organic photoreceptor according to claim 3 wherein said charge transport layer is intermediate said charge generating layer and said electroconductive substrate.

13. An organic photoreceptor according to claim 3 wherein said charge generating layer is intermediate said charge transport layer and said electroconductive substrate.

14. An electrophotographic imaging apparatus comprising:

(a) a plurality of support rollers; and (b) an organic photoreceptor in the form of a flexible belt supported by said support rollers, said organic photoreceptor comprising:

(i) a first charge transport compound having the formula:

(1)

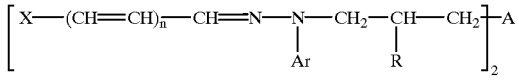

where X is an N-alkyl-substituted carbazole, an N-aryl-substituted carbazole, or a p-(N,N-disubstituted)arylamine;

Ar is a group having the formula:

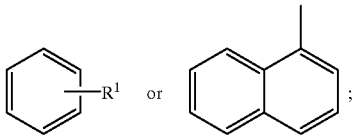

$R^1$ is a hydrogen, halogen, or alkyl group;

R is a hydrogen, halogen, OH, CN, $OR^2$, or $OCOR^3$ group;

$R^2$ is an alkyl, aryl, or alkaryl group;

$R^3$ is a hydrogen, alkyl, aryl, or haloalkyl group;

n is 0 or 1;

A is a group having the formula:

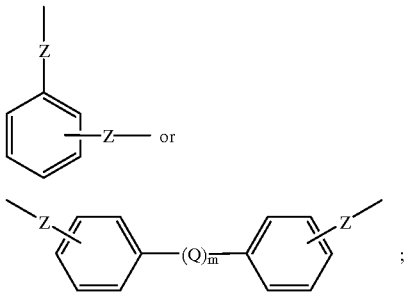

Z is O or S;

Q is O, S, or $CH_2$; and m is 0 or 1;

(ii) a charge generating compound; and (iii) an electroconductive substrate.

15. An apparatus according to claim 14 wherein at least one of said support rollers has a diameter no greater than about 40 mm.

16. An apparatus according to claim 14 further comprising a liquid toner dispenser.

17. An electrophotographic imaging process comprising:

(a) applying an electrical charge to a surface of an organic photoreceptor comprising:

(i) a first charge transport compound having the formula:

(1)

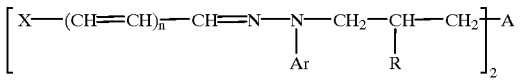

where X is an N-alkyl-substituted carbazole, an N-aryl-substituted carbazole, or a p-(N,N-disubstituted) arylamine;

Ar is a group having the formula:

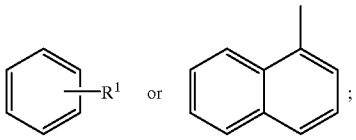

$R^1$ is a hydrogen, halogen, or alkyl group;

R is a hydrogen, halogen, OH, CN, $OR^2$, or $OCOR^3$ group;

$R^2$ is an alkyl, aryl, or alkaryl group;

$R^3$ is a hydrogen, alkyl, aryl, or haloalkyl group;

n is 0 or 1; and

A is a group having the formula:

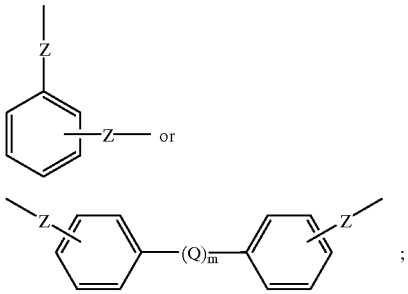

Z is O or S;

Q is O, S, or $CH_2$; and m is 0 or 1;

(ii) a charge generating compound; and (iii) an electroconductive substrate;

(b) imagewise exposing said surface of said organic photoreceptor to radiation to dissipate charge in selected areas and thereby form a pattern of charged and discharged areas on said surface;

(c) contacting said surface with a liquid toner comprising a dispersion of colorant particles in an organic liquid to create a toned image; and (d) transferring said toned image to a substrate.

18. An imaging process according to claim 17 wherein said organic photoreceptor is in the form of a flexible belt supported by a plurality of support rollers.

19. An imaging process according to claim 18 wherein at least one of said support rollers has a diameter no greater than about 40 mm.

20. An organic photoreceptor comprising:

(a) the reaction product of a reaction mixture comprising a multi-functional isocyanate and a charge transport compound having the formula:

(1)

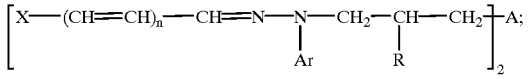

where X is an N-alkyl-substituted carbazole, an N-aryl-substituted carbazole, or a p-(N,N-disubstituted) arylamine;

Ar is a group having the formula:

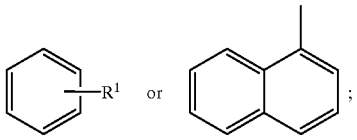

$R^1$ is a hydrogen, halogen, or alkyl group;

R is a hydroxy group;

$R^2$ is an alkyl, aryl, or alkaryl group;

$R^3$ is a hydrogen, alkyl, aryl, or haloalkyl group;

n is 0 or 1;

A is a group having the formula:

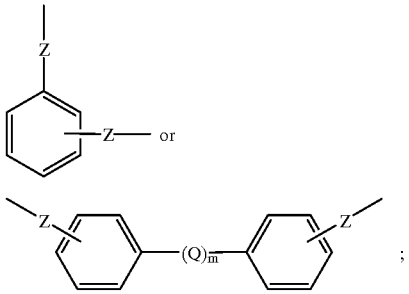

Z is O or S;

Q is O, S, or $CH_2$; and m is 0 or 1;

(b) a charge generating compound; and (c) an electroconductive substrate.

21. An organic photoreceptor according to claim 20 wherein said reaction mixture comprises said multi-functional isocyanate, said charge transport compound, and a hydroxy-functional compound.

22. An organic photoreceptor according to claim 21 wherein said hydroxy-functional compound comprises a hydroxy-functional polymeric binder.

23. An organic photoreceptor according to claim 22 wherein said hydroxy-functional polymeric binder comprises polyvinyl butyral.

24. An organic photoreceptor according to claim 20 comprising:

(a) a charge transport layer;

(b) a charge generating layer; and (c) an electroconductive substrate, wherein said charge transport layer comprises said reaction product of said charge transport compound and said multi-functional isocyanate.

25. An organic photoreceptor according to claim 20 wherein said photoreceptor is in the form of a flexible belt.
26. An organic photoreceptor according to claim 20 wherein said charge transport compound is selected from the group consisting of
(2)
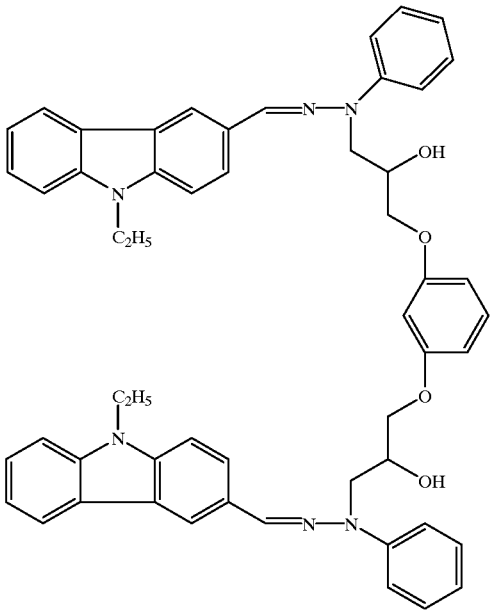
;
(3)
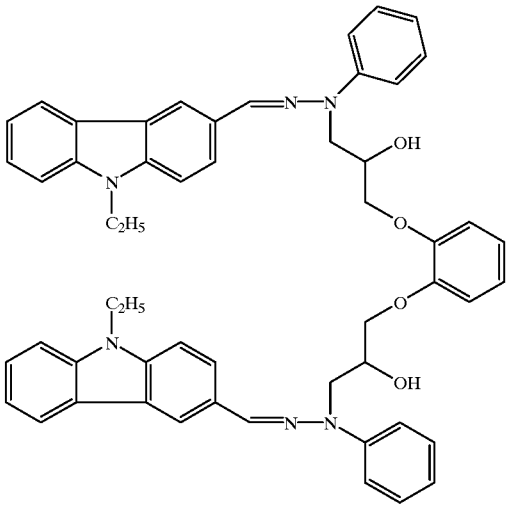
;
-continued
(4)
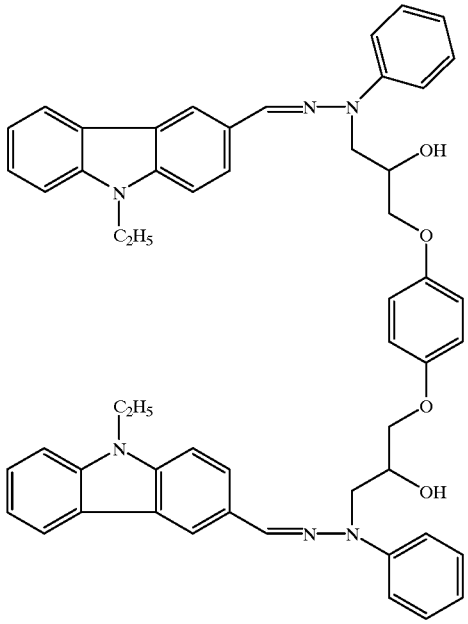
;
(5)
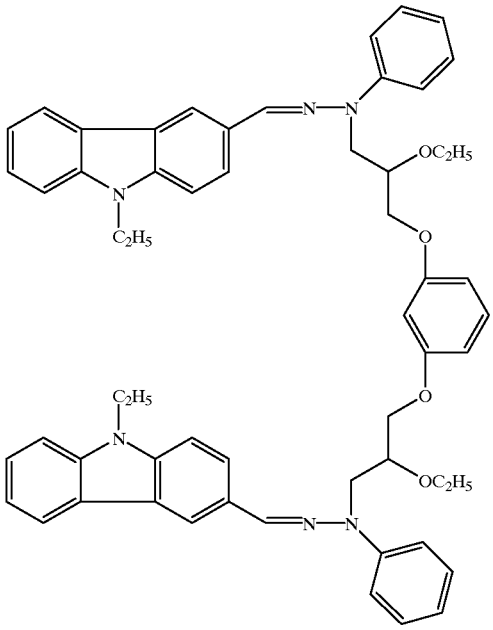
;

-continued
(6)
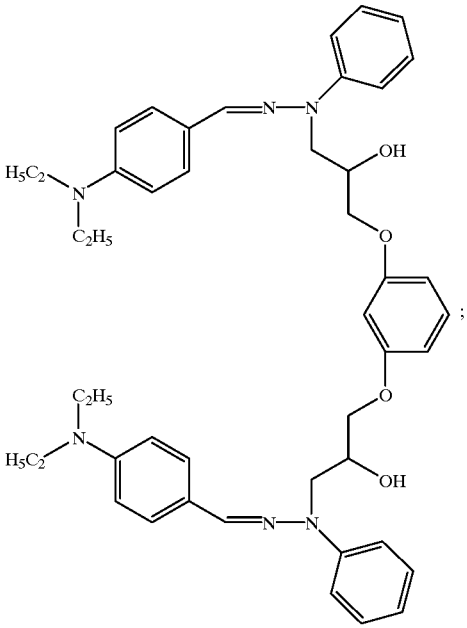
;
(7)
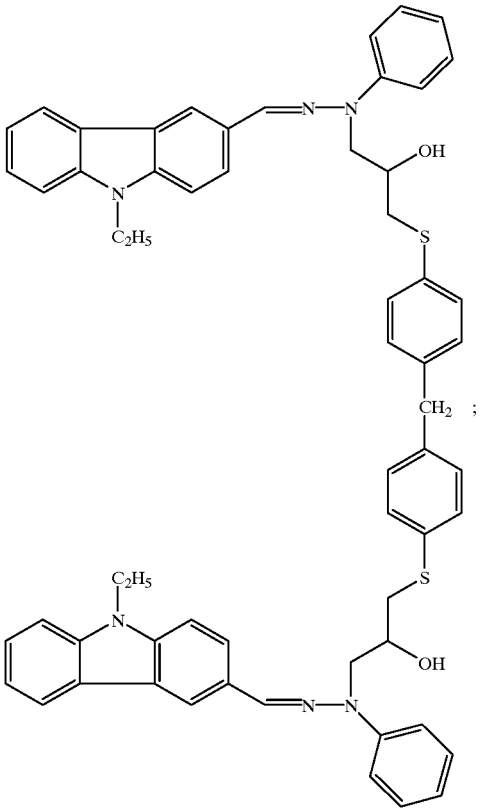
;
-continued
(8)
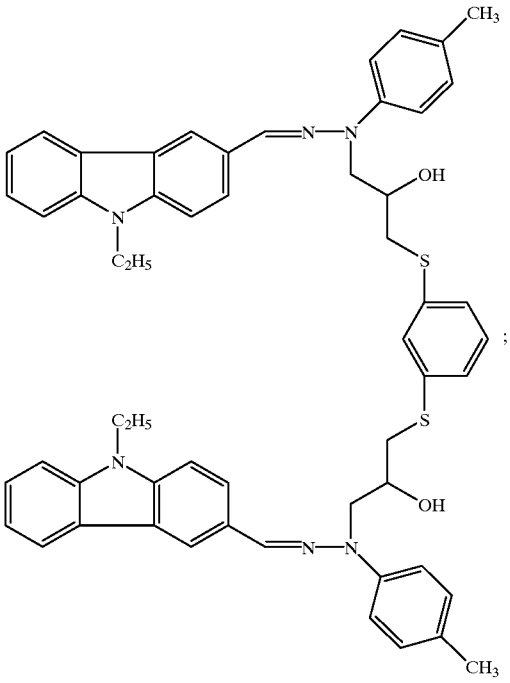
;
(9)
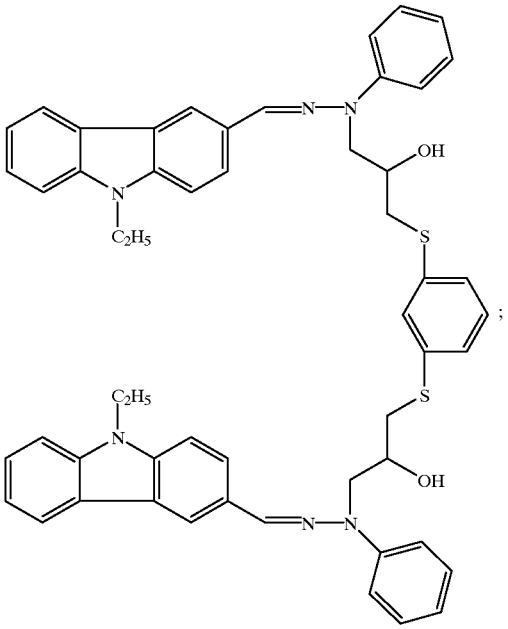
;

-continued (10)

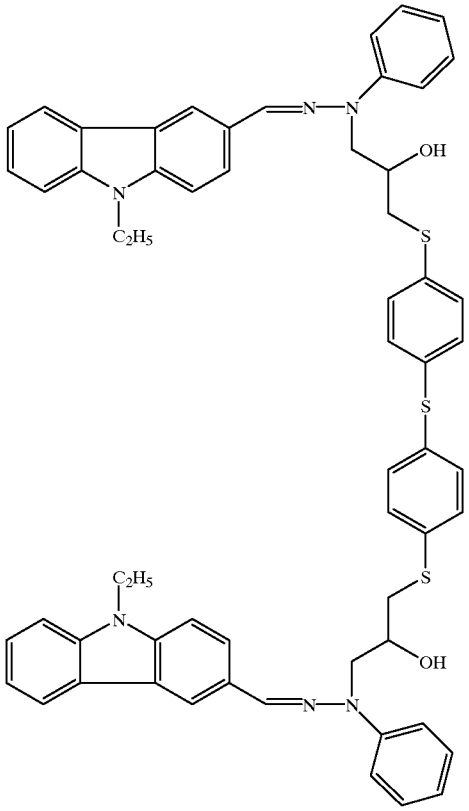

;

(11)

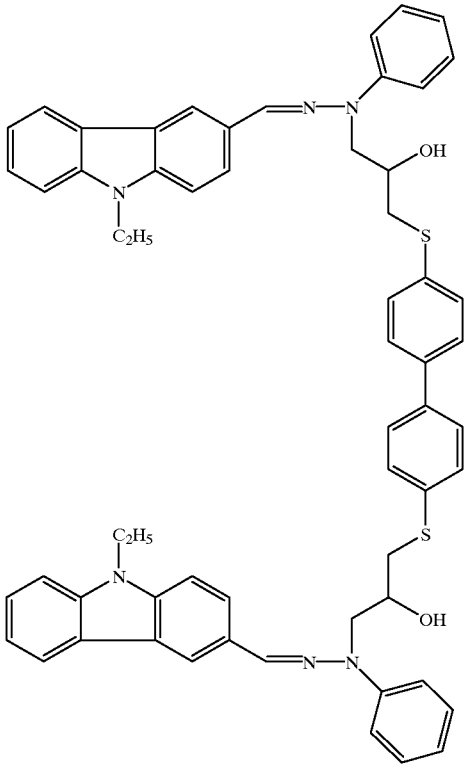

;

and combinations thereof.

27. An electrophotographic imaging apparatus comprising:

(a) a plurality of support rollers; and (b) an organic photoreceptor in the form of a flexible belt supported by said support rollers, said organic photoreceptor comprising (i) the reaction product of a reaction mixture comprising a multi-functional isocyanate and a charge transport compound having the formula:

(1)

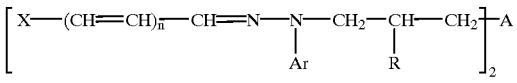

where X is an N-alkyl-substituted carbazole, an N-aryl-substituted carbazole, or a p-(N,N-disubstituted) arylamine;

Ar is a group having the formula:

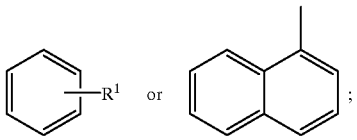

;

$R^1$ is a hydrogen, halogen, or alkyl group;

R is a hydroxy group;

$R^2$ is an alkyl, aryl, or alkaryl group;

$R^3$ is a hydrogen, alkyl, aryl, or haloalkyl group;

n is 0 or 1;

A is a group having the formula:

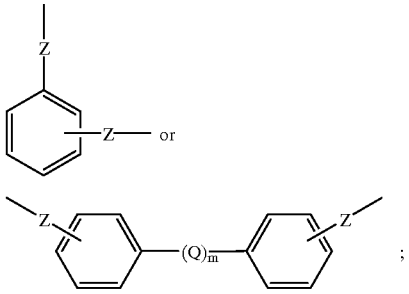

;

Z is O or S;

Q is O, S, or $CH_2$; and m is 0 or 1;

(ii) a charge generating compound; and (iii) an electroconductive substrate.

28. An apparatus according to claim 27 wherein at least one of said support rollers has a diameter no greater than about 40 mm.

29. An apparatus according to claim 27 further comprising a liquid toner dispenser.

30. An electrophotographic imaging process comprising:

(a) applying an electrical charge to a surface of an organic photoreceptor comprising:

(i) the reaction product of a reaction mixture comprising a multi-functional isocyanate and a charge transport compound having the formula:

(1)

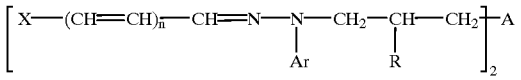

where X is an N-alkyl-substituted carbazole, an N-aryl-substituted carbazole, or a p-(N,N-disubstituted) arylamine;

Ar is a group having the formula:

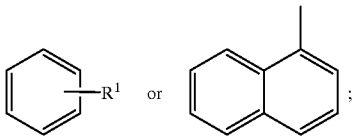

$R^1$ is a hydrogen, halogen, or alkyl group;

R is a hydroxy group;

$R^2$ is an alkyl, aryl, or alkaryl group;

$R^3$ is a hydrogen, alkyl, aryl, or haloalkyl group;

n is 0 or 1;

A is a group having the formula:

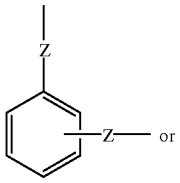

-continued

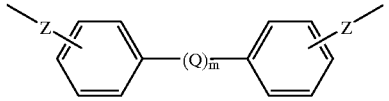

Z is O or S;

Q is O, S, or $CH_2$; and m is 0 or 1;

(ii) a charge generating compound; and (iii) an electroconductive substrate;

(b) imagewise exposing said surface of said organic photoreceptor to radiation to dissipate charge in selected areas and thereby form a pattern of charged and discharged areas on said surface;

(c) contacting said surface with a liquid toner comprising a dispersion of colorant particles in an organic liquid to create a toned image; and (d) transferring said toned image to a substrate.

31. An imaging process according to claim 30 wherein said organic photoreceptor is in the form of a flexible belt supported by a plurality of support rollers.

32. An imaging process according to claim 31 wherein at least one of said support rollers has a diameter no greater than about 40 mm.

* * * * *